United States Patent [19]

Resca

[11] Patent Number: 4,709,497

[45] Date of Patent: Dec. 1, 1987

[54] HANDGUN FRAME WITH FIXED BARREL BUSHING

[76] Inventor: Franco Resca, 117 Oak Avenue, Cullinan, Transvaal Province, South Africa

[21] Appl. No.: 18,860

[22] Filed: Feb. 25, 1987

Related U.S. Application Data

[63] Continuation-in-part of Ser. No. 750,332, Jun. 28, 1985, abandoned.

[51] Int. Cl.[4] ..... F41C 21/22

[52] U.S. Cl. ..... 42/75.02; 42/7

[58] Field of Search ..... 42/7, 75.01, 75.02, 42/75.03, 75.04, 97; 89/14.3, 163, 196

[56] References Cited

U.S. PATENT DOCUMENTS

| | | | |
|---|---|---|---|
| 1,636,357 | 7/1927 | Cutts, Jr. | 89/14.3 |
| 1,738,751 | 12/1929 | Bluehdorn | 89/163 |
| 2,149,707 | 3/1939 | Murbach | 42/75 B |
| 2,464,010 | 3/1949 | Vonella | 89/14.3 |
| 2,872,850 | 2/1959 | Davenport | 89/159 |
| 3,060,810 | 10/1962 | Hillberg | 89/196 |
| 3,504,594 | 4/1970 | Greeley | 89/163 |
| 3,657,959 | 4/1972 | Kart | 89/128 |
| 3,724,326 | 4/1973 | Day | 89/196 |
| 3,999,321 | 12/1976 | Musgrave | 42/7 |
| 4,127,056 | 11/1978 | Kart | 89/128 |
| 4,253,377 | 3/1981 | Arnett | 89/163 |
| 4,513,523 | 4/1985 | Gal | 42/72 |
| 4,520,585 | 6/1985 | Barrett | 42/7 |

FOREIGN PATENT DOCUMENTS

| | | | |
|---|---|---|---|
| 72592 | 2/1982 | European Pat. Off. | 89/14.4 |
| 2517797 | 1/1976 | Fed. Rep. of Germany | 42/75 B |

*Primary Examiner*—Deborah L. Kyle
*Assistant Examiner*—Ted L. Parr
*Attorney, Agent, or Firm*—Pravel, Gambrell, Hewitt, Kimball & Krieger

[57] ABSTRACT

A handgun frame is provided for receiving a barrel and slide of the type operating on the Browning short recoil principle. The frame includes a magazine well defined within a grip formation. An elongated cantilever support extends forwardly from the grip formation to a position beyond a forward end of the barrel. A barrel bushing is rigidly fixed to and directly mounted on a forward end of the cantilever support for slidably supporting a front end of the barrel therein. Slide support means slidably support the slide.

6 Claims, 11 Drawing Figures

HANDGUN FRAME WITH FIXED BARREL BUSHING

This is a continuation-in-part of co-pending application Ser. No. 750,332 filed on June 28, 1985, now abandoned.

This invention relates to a handgun frame.

BACKGROUND OF THE INVENTION

A conventional handgun which operates on the Browning short recoil principle suffers from the disadvantage that its barrel is supported by a barrel bushing which in turn is supported by a slide which in turn is carried on a frame. There is inevitably some play between the frame and the slide and between the barrel and the barrel bushing. Such play can give rise to inaccuracy during firing. The barrel bushing also adds to the mass of the slide and as it moves with the slide during firing, its additional mass can contribute to failure of the handgun. It is an object of this invention to offer a solution to this problem.

BRIEF SUMMARY OF THE INVENTION

According to the invention there is provided a handgun frame for receiving a barrel and slide of the type operating on the Browning short recoil principle, the frame including a magazine well defined within a grip formation, an elongated cantilever support extending forwardly from the grip formation to a position beyond a forward end of the barrel, a barrel bushing rigidly fixed to and directly mounted on a forward end of the cantilever support for slidably supporting a front end of the barrel therein, and slide support means for slidably supporting the slide.

In a preferred embodiment, the grip formation, elongated cantilever support and slide support means may be integrally formed.

The barrel bushing may be removably fixed to the cantilever support, e.g. by screws, dowels, or the like, to permit various barrels to be located on the frame.

The frame may further include a muzzle brake. The muzzle brake may be integrally formed with the barrel bushing.

The muzzle brake may define a chamber larger than a bore of the barrel, the chamber having at least one outlet port therein. The port allows release of gases resulting from firing of the handgun. The port or ports may extend upwardly and rearwardly relative to the barrel so that gases discharged therefrom tend to counteract against upward recoil of the forward end of the handgun during firing.

The chamber may have a forward end with an outlet therein which is narrower than the remainder of the chamber. The outlet may be slightly larger than the bore of the barrel.

The barrel bushing or muzzle brake may have a front sight thereon in which case the front sight normally provided on the slide can be removed thereby giving an extended sight radius for the handgun.

The grip formation may have a mouth for receiving a magazine, the walls defining the mouth being flared outwardly to facilitate rapid insertion of the magazine.

Instead of the grip formation having a flat forward wall, a lower end of the forward wall may extend forwardly at an acute angle relative to the remainder of the wall to facilitate gripping of the grip formation. In another embodiment, the forward wall of the grip formation may be arcuately curved along at least portion of its length to form a concave surface to facilitate gripping of the grip formation.

The frame may further have a trigger guard extending forwardly and then upwardly from the grip formation, the upwardly extending portion of the trigger guard being attached to the cantilever support. The trigger guard also serves to provide additional support for the cantilever support. The upwardly extending portion of the trigger guard may have a forwardly directed flat face which, instead of extending at right angles relative to the barrel, may slope rearwardly over at least portion of its width. When used by a right handed person, the upwardly extending portion of the trigger guard would slope rearwardly from the right of the barrel and when used by a left handed person, would slope rearwardly from the left of the barrel, to facilitate gripping of the handgun with two hands. The upwardly extending portion of the trigger guard provides a convenient gripping surface for the index finger of the left hand of a right handed person and of the right hand for a left handed person.

The upwardly extending portion of the trigger guard and/or portions of the grip formation may have serrations or the like thereon to facilitate gripping of the handgun.

The slide support means and cantilever support would normally be custom made to suit a particular form of slide to be fitted to the frame. The slide support means may be adapted to receive a variety of lengths of slide. A typical slide support means would be in the form of slots and rails formed in the frame.

BRIEF DESCRIPTION OF THE DRAWINGS

An embodiment of the invention is now described by way of example with reference to the accompanying drawings, in which.

DESCRIPTION WITH REFERENCE TO ACCOMPANYING DRAWINGS

Figure 1:
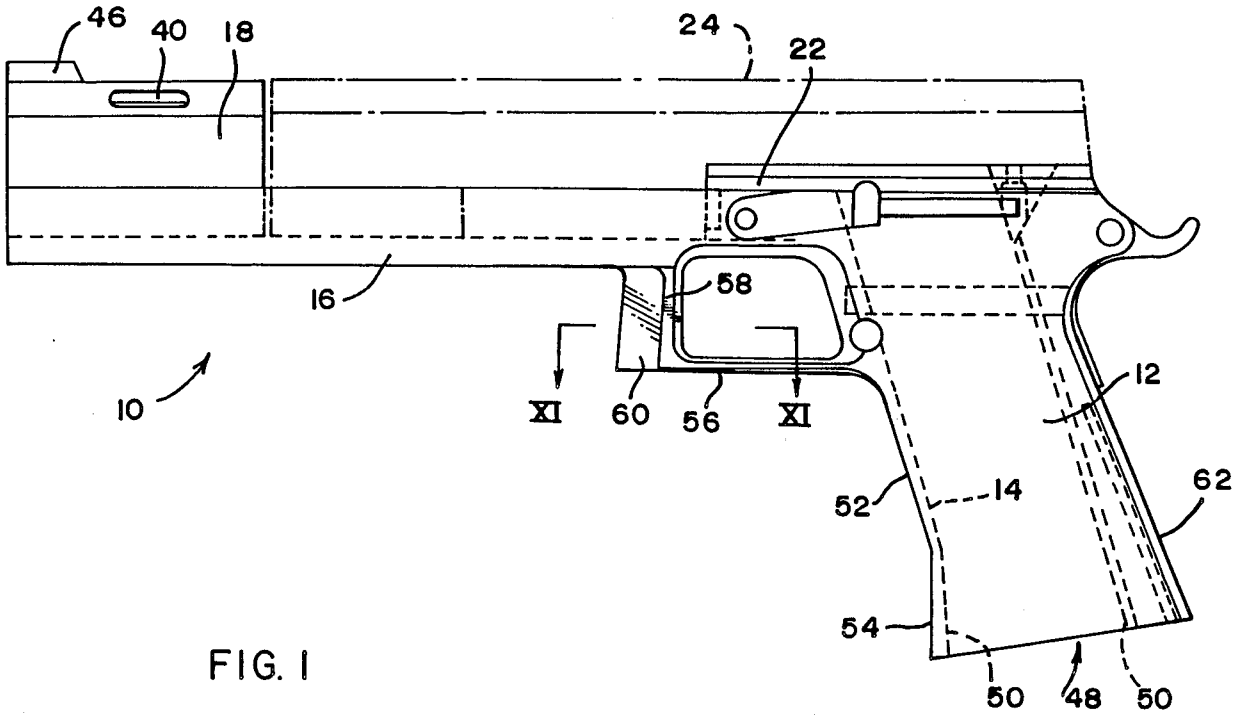
FIG. 1 shows a side elevation of a handgun frame in accordance with the invention.
Figure 2:
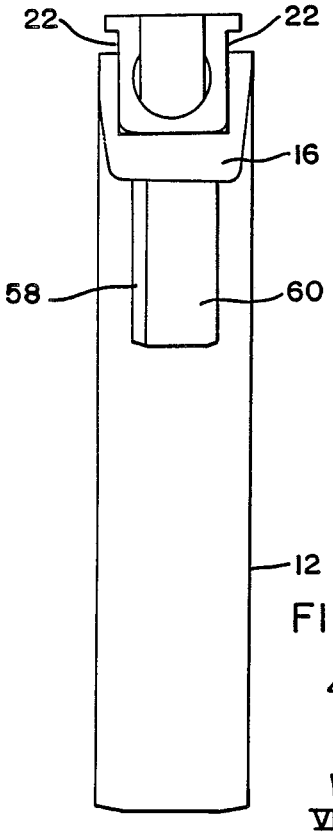
FIG. 2 shows a front end view of the handgun frame.

Referring to the drawings, reference numeral 10 generally indicates a handgun frame having a grip formation 12 defining a magazine well 14 therein. An elongated cantilever support 16 extends forwardly from the grip formation 12 to a position beyond the forward end of a barrel 30. The forward end of the support 16 has a muzzle brake 18 which incorporates a barrel bushing 20 therein for removably supporting the front end of one of a variety of barrels on the frame. The frame 10 also has slide support means in the form of slots 22 for removably supporting one of a variety of lengths of slides. A typical slide is indicated by dotted lines at 24 and would be substantially of conventional form with internal locking lugs (not shown) in its upper mid section, which lugs engage corresponding lugs (also not shown) on a hood of the barrel.

As shown more clearly in FIGS. 8 to 11, the muzzle brake is rigidly fixed to and directly mounted on the forward end of the cantilever support 16 by attachment screws 26. Dowels or the like may also be used to locate the muzzle brake on the cantilever support 16. The barrel bushing 20 has a bore 28 for slidably supporting the barrel 30. The bore 28 provides a large surface area for slidably supporting the barrel 30 and takes the place of the normal barrel bushing usually provided in the slide 24. The bore 28 may be provided in a separate bushing in the muzzle brake 18 rather than as shown. Various bushings can then be provided of different lengths to cater for standard length barrels and also for longer barrels. When a standard length barrel is used, the bushing would protrude rearwardly from the muzzle towards the slide and for longer barrels, the bushing would terminate closer to or at the rearward end of the muzzle brake. The bore 28 of the barrel bushing 20 has a relief (not shown) therein in its lower rearward portion to accommodate the slight downward tilting of the barrel during firing when the lugs on the barrel disengage from the locking lugs on the slide.

Figure 8:
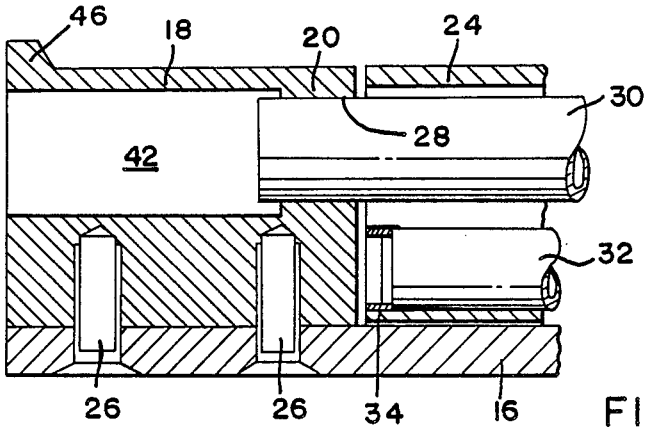
FIG. 8 shows a sectional side elevation along line VIII—VIII of FIG. 5.
Figure 9:
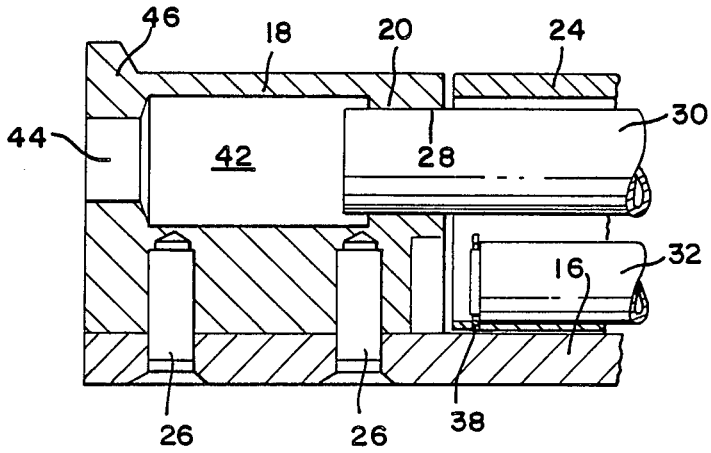
FIGS. 9 and 10 show sectional side elevations similar to FIG. 8 and show modifications of the manner of locating the spring plunger of the slide of the handgun.
Figure 10:
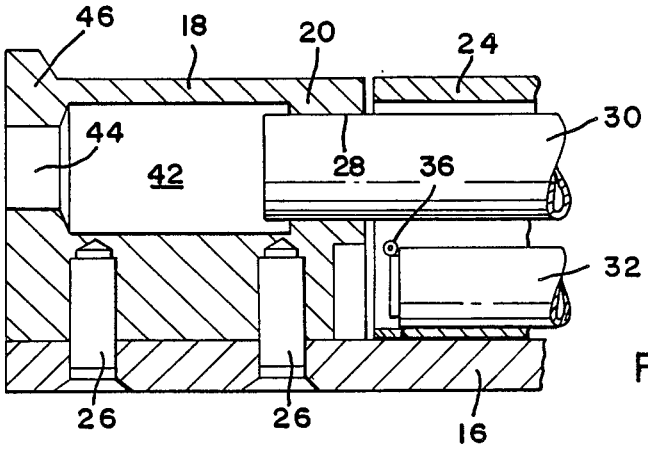

In FIG. 8, a main spring plunger 32 of the slide 24 is held in position by and abuts against a threaded sleeve 34 screwed into the slide 24. The main spring plunger 32 could also be held in position by a bayonet fitting, or by a pin 36 as shown in FIG. 10, or by a circlip 38 located in a suitable recess as shown in FIG. 9. A grub screw (not shown) screw threadedly receivable in the slide 24 could also be used to hold the plunger 32.

Figure 5:
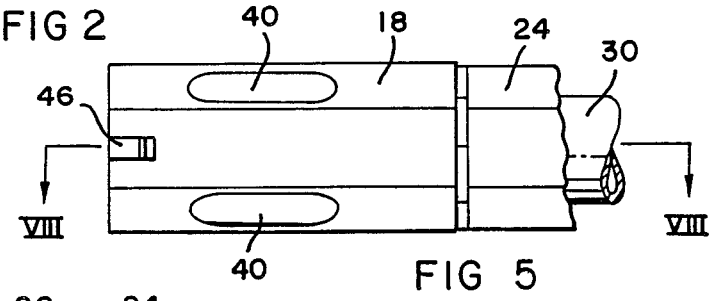
FIG. 5 shows a plan view of the barrel bushing and muzzle brake of FIG. 4.
Figure 6:
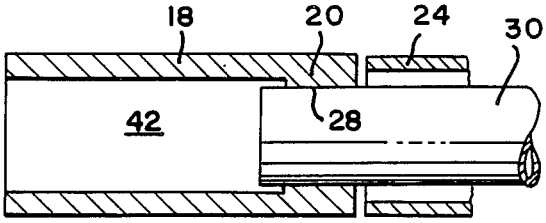
FIG. 6 shows a sectional plan view of the barrel bushing and muzzle brake of FIGS. 4 and 5.

As shown in FIGS. 1 and 5, the muzzle brake 18 has, in this embodiment, a pair of ports 40 therein. The ports 40 extend upwardly and rearwardly relative to the longitudinal axis of the muzzle brake 18 so that gases discharged from the ports 40 tend to counteract against upward recoil of the forward end of the handgun during firing. A protective pad (not shown) of rubber or the like may be provided on the lower forward end of the cantilever support 16 to minimise damage to a rest when the handgun is rested thereon during firing. A foldable bipod (not shown) can also be attached to the lower forward end of the cantilever support.

Figure 7:
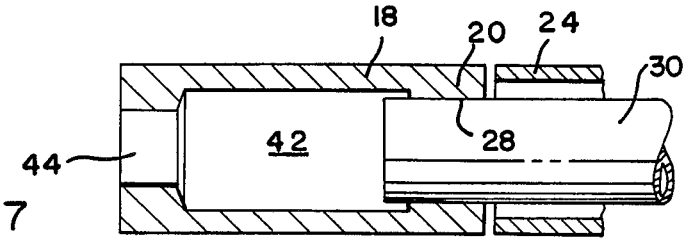
FIG. 7 shows a sectional plan view of a modified form of barrel bushing and muzzle brake.

The muzzle brake 18 defines a chamber 42 and in the preferred form shown in FIGS. 7, 9 and 10, the outlet 44 is narrower than the remainder of the chamber 42 to cause pressurisation of the chamber 42 during firing. The outlet 44 is preferably slightly larger than the bore of the barrel 30. The outlet 44 is conveniently worked to its final dimensions by using an expanding mandrel in the barrel to guide a cutting reamer. The outlet 44 can thus be worked to close tolerances to maximise pressure in the chamber 42.

The muzzle brake 18 also has a front sight 46 thereon and accordingly the front sight normally provided on the slide 24 can be omitted. By reason of the extra length of the cantilever support 16 compared to a conventional handgun, an increased sight radius is afforded thereby facilitating accurate sight alignment.

Figure 3:
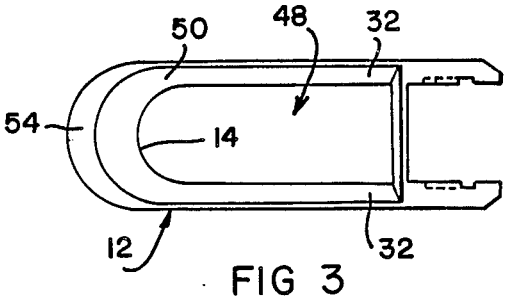
FIG. 3 shows an underneath plan view of the grip and magazine well of the handgun frame.
Figure 4:
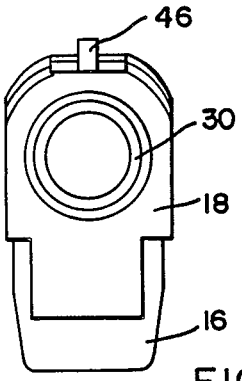
FIG. 4 shows a front elevation of a barrel bushing and muzzle brake of the handgun frame.

As shown in FIGS. 1 and 3, the magazine well 14 has a mouth 48 for receiving a magazine. The outer end of the mouth 48 is flared having tapering walls 50 to facilitate rapid insertion of the magazine. The width of the magazine well can be varied to accommodate magazines of various capacities.

As shown in FIG. 1, the front wall 52 of the grip formation 12 has a lower portion 54 extending forwardly to facilitate gripping of the grip formation.

Figure 11:
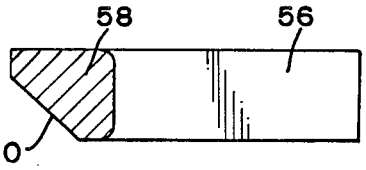
FIG. 11 shows a sectional plan view of the trigger guard along lines XI—XI of FIG. 1.

As shown in FIGS. 1 and 11, the handgun frame has a trigger guard comprising a forwardly extending portion 56 and an upwardly extending portion 58. The trigger guard provides additional support for the cantilever support 16. A forward flat face 60 of the upwardly extending portion 58 slopes rearwardly over portion of its width from right to left in this embodiment and is therefore intended for a right handed person so that the person can grip the handgun with two hands, the forward face 60 of the upwardly extending portion 58 providing a convenient gripping surface for the index finger of the person's left hand.

The forward face 60 of the upwardly extending portion 58 is further provided with serrations (not shown). Similar serrations may be provided on the front wall 52 of the grip 12, and also on a rear wall 62 of the grip formation.

The invention illustrated provides a handgun frame which can support thereon a variety of barrels and a variety of lengths of slides thereby a permit a person to choose a particular form of slide or barrel, e.g. of different lengths and calibres. The frame can further be made of a variety of materials. For example, in certain applications, it may be desirable to have a heavy handgun in which case the frame can be made thicker or of a heavier material than conventional handguns. In other applications where a light handgun is desirable, the frame could be made of a light metal, such as an aluminum alloy or the frame could be lightened by removing excess material therefrom. A frame having a particular mass can therefore be chosen to suit a particular person. A variety of barrels of different calibres and lengths can be fitted on the frame with a suitable barrel bushing and muzzle brake. A variety of lengths of slides can also be selected. As the barrel bushing is rigidly fixed directly onto the frame rather than being incorporated in the slide, there is less play between the barrel and the frame than there is in a conventional handgun where there is play between the barrel and the barrel bushing and also play between the slide and the frame. This permits greater accuracy. Full powered cartridges of a large calibre can be fired with the handgun. The cantilever support provides a large sturdy mass for supporting the barrel and minimises the risk of cracking occurring. As the barrel bushing is static, the slide has less overall mass than conventional handguns where the barrel bushing moves with the slide during firing.

A conventional handgun can be converted readily to a handgun in accordance with this invention by simply replacing the conventional frame and conventional barrel bushing with a frame with a fixed barrel bushing of the present invention. The handgun can also be converted back to a conventional handgun in similar fashion.

While converted, the cantilever support forms a concentrated mass bringing the centre of gravity of the handgun closer to the middle of the length of the handgun than is the case with conventional handguns. This allows the handgun to be fired with greater accuracy.

I claim:

1. A handgun frame for receiving a barrel and slide of the type operating on the Browning short recoil principle, the frame including a magazine well defined within a grip formation, an elongated cantilever support extending forwardly from the grip formation to a position beyond a forward end of the barrel, a barrel bushing rigidly fixed to and directly mounted on a forward end of the cantilever support for slidably supporting a front end of the barrel therein, and slide support means for slidably supporting the slide.

2. A handgun frame as claimed in claim 1, in which the grip formation, elongated cantilever support and slide support means are integrally formed.

3. A handgun frame as claimed in claim 1, in which the barrel bushing is removably fixed to the cantilever support to permit various barrels to be located on the frame.

4. A handgun frame as claimed in claim 1, which further includes a muzzle brake which is integrally formed with the barrel bushing.

5. A handgun frame as claimed in claim 4, in which the muzzle brake defines a chamber larger than a bore of the barrel, the chamber having at least one outlet port therein, the port extending upwardly and rearwardly relative to a longitudinal axis of the chamber.

6. A handgun frame as claimed in claim 5, in which the chamber has a forward end with an outlet therein which is narrower than the remainder of the chamber.

* * * * *